US005536016A

United States Patent [19]

Thompson

[11] Patent Number: 5,536,016

[45] Date of Patent: Jul. 16, 1996

[54] PROGRESSIVE SYSTEM FOR A MATCH NUMBER GAME AND METHOD THEREFOR

[75] Inventor: David J. Thompson, Las Vegas, Nev.

[73] Assignee: Mikohn Gaming Corporation, Las Vegas, Nev.

[21] Appl. No.: 311,959

[22] Filed: Sep. 26, 1994

[51] Int. Cl.[6] ..... A63F 1/00

[52] U.S. Cl. ..... 273/269; 273/274; 273/292

[58] Field of Search ..... 273/237, 269, 273/270, 274, 292, 309

[56] References Cited

U.S. PATENT DOCUMENTS

| | | | |
|---|---|---|---|
| 1,655,380 | 1/1928 | Parker . | |
| 4,019,744 | 4/1977 | Pizur, Sr. . | |
| 4,861,041 | 8/1989 | Jones et al. | 273/309 |
| 5,022,653 | 6/1991 | Suttle et al. | 273/274 |
| 5,029,871 | 7/1991 | Willson, Jr. et al. | 273/271 |
| 5,127,656 | 7/1992 | Simpson | 273/269 |
| 5,364,104 | 11/1994 | Jones et al. | 273/309 |
| 5,393,057 | 2/1995 | Marnell, II | 273/269 |
| 5,401,024 | 3/1995 | Simunek | 273/269 |

*Primary Examiner*—Vincent Millin
*Assistant Examiner*—William M. Pierce
*Attorney, Agent, or Firm*—Dorr, Carson, Sloan & Birney

[57] ABSTRACT

A progressive system for a match number game. An ante coin acceptor is located near each played card on each player's station. A progressive coin acceptor is also located on each player station. A player places an ante bet or a progressive bet by placing coins in the ante and progressive coin acceptors. A controller controls the operation of the coin acceptors.

The operator of the game causes the ante and progressive controllers connected to all ante and progressive acceptors to drop all sensed coins into a drop bucket, to activate verification light at each acceptor that the coin has been received and to lockout the coin acceptor to prevent future insertion of coins. The game is played by announcing randomly selective numbers from 1 to 30. At the beginning of the game, the first three randomly selected numbers called, if those three match on a given card and if the player has placed a progressive bet, the player wins the progressive jackpot.

9 Claims, 6 Drawing Sheets

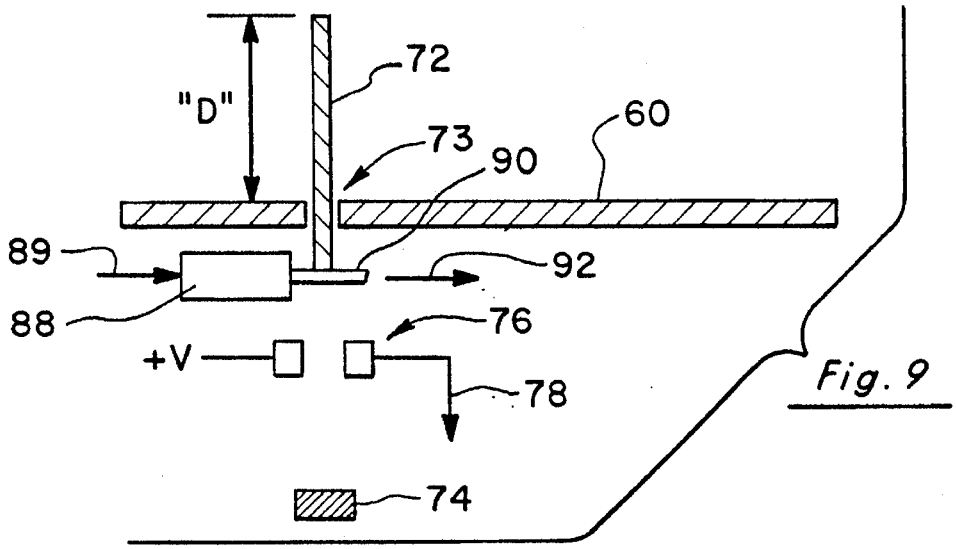
Fig. 9
Fig. 10
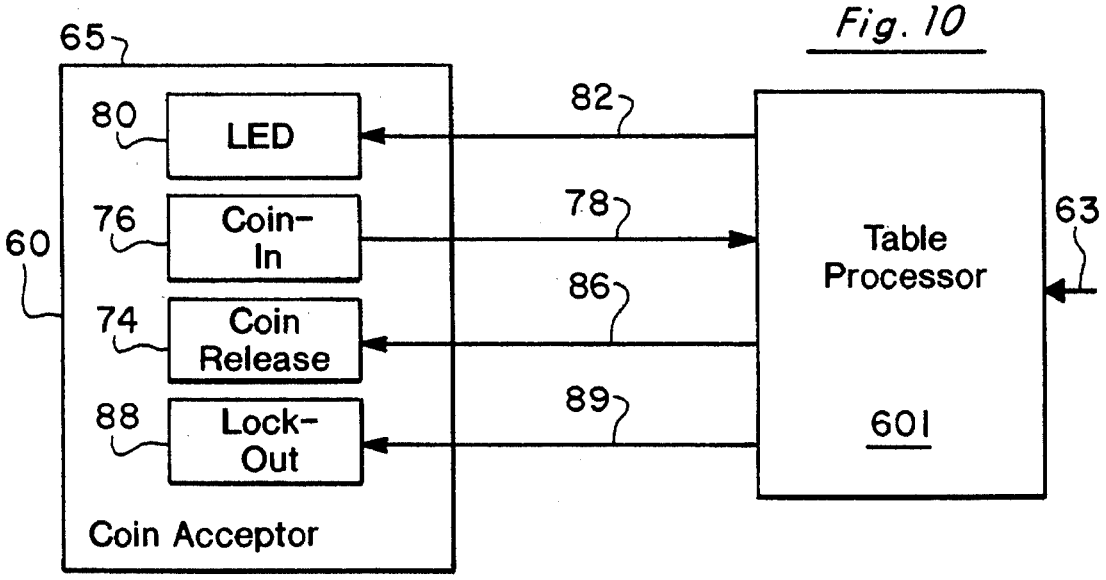
Fig. 11
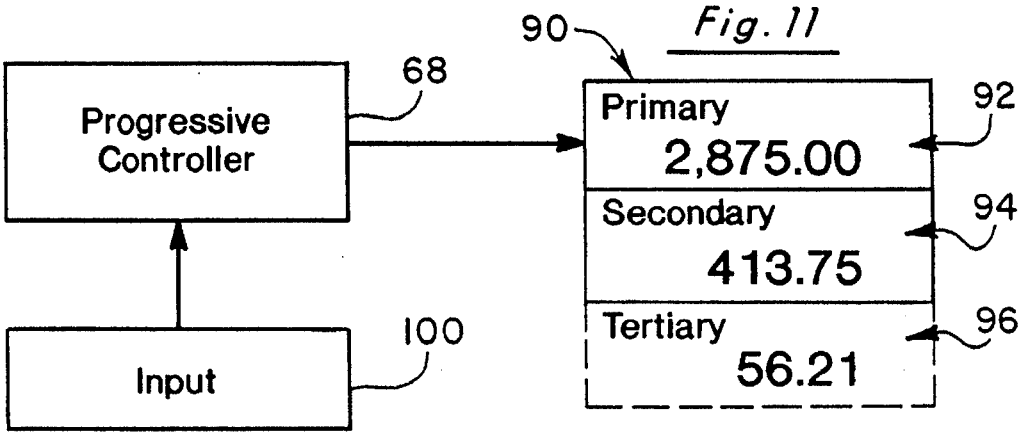

PROGRESSIVE SYSTEM FOR A MATCH NUMBER GAME AND METHOD THEREFOR

BACKGROUND OF THE INVENTION

1. Field of the Invention

The present invention relates to a match number game wherein balls bearing a number are randomly selected and wherein the selected number on the ball is called and matched by players to one of three numbers on one or a plurality of game cards and, more particularly, the present invention relates to a progressive system for a match number game.

2. Brief Statement of the Problem

In certain parts of the world, a game called match number is played wherein only three numbers appear on a game card. Match number is played in the manner of Bingo and Keno, but is unlike those games in how it is played. In FIG. 1, the prior art game card 10 for match number is shown having three numbers $R_1$, $R_2$ and $R_3$. The number $R_1$ is in a top number range of numbers from 1 to 10. Number $R_2$ is in the middle number range of numbers from 11 to 20 and number $R_3$ is in a bottom number range from 21 to 30. The numbers are displayed on the card 10.

In FIG. 2, the match number game also uses a plurality of balls such as 30 with each ball bearing a number $N_1$, $N_2$, . . . $N_{30}$. It is well known in the gaming industry to also have an electronic random number generator to generate numbers $N_1$ through $N_{30}$ electronically and digitally display them in a conventional matrix display.

Match number games are typically played with a large number of participants. For example in FIG. 3, a prior art gaming room 30 is shown for a large number of player stations 32 which in FIG. 3 number 100. Any number of player stations could be used. Players 34 sit on one side of the player stations 32. Betting personnel 36 are on the opposite sides of the table. The game is run by an overall game caller 38 at a central location having a ball blower 39. It can be readily observed that a need exists in such a large game with so many players to automate the betting procedure as much as possible.

In FIG. 4, two prior art player stations **32*a* and 32*b* are shown. Player 34*a* sits at station 32*a* and player 34*b* sits at station 32*b*. A player 34 in a typical prior art match number game may play any number of cards up to a fixed number such as 4. Hence player 34*a* is shown playing three cards and player 34*b* is playing one card 10**. Each card, of course, has randomly selected numbers in the number ranges $R_1$, $R_2$, and $R_3$.

The game is played as follows. The player 34 selects one to four game cards 10. Each player playing the game of FIG. 3 has a unique game card 10 in that no two game cards are alike. The player 34 places the game card as shown in FIG. 4 on the playing surface 40 of the player station 32. In front of each card 10 and towards the assistant 36 each player first places an ante bet $B_1$ and then places a game bet $B_2$. The ante bet $B_1$ is a fixed amount such as one coin. Game bet $B_2$ is also a fixed amount such as three coins. Each player playing the game of FIG. 3 places bets $B_1$ and $B_2$. The assistant 36 observes this to be true. When the bets are placed, the assistants 36 sweep off ante bets $B_1$ from the surface 40 of each player station 32. The ante bet $B_1$ is the house take for running the game. A need exists to provide accounting so as to prevent theft from occurring during this sweep by any assistant.

The game bet $B_2$ banks the game and when a player playing the game of FIG. 3 is the first to match all three numbers on his card 10 when the balls 20 are called, an assistant 36 observes this as being the winning card and then the assistants 36 sweep off bets $B_2$ and deliver all of the game bets $B_2$ to the winning player 34.

It can be appreciated that this is a very fast game lasting on the order of 15 to 55 seconds per game. It is also appreciated that an extensive amount of manual effort is required by the assistants 36 in sweeping off ante bets $B_1$ and sweeping off game bets $B_2$. A need, therefore, exists to automate this process as much as possible.

Between games, each player has the opportunity to select new cards 10 to increase or decrease their number of cards 10, and so forth. In a typical environment, the time between games may be several minutes. Therefore, it can be appreciated that during an evening of match number game playing, a significant number of games can be played thereby underscoring the need to highly automate this game.

A need also exists to reduce cheating and fraud that may occur due to human interaction with playing and collecting the bets.

A further need exists to make the match number game of FIGS. 1–4 progressive in nature by adding a level of additional betting and overall excitement from game to game. Such a progressive level of betting and anticipation would continue from game to game with an overall jackpot building up.

3. Solution to the Problem

The present invention provides a solution to the problem by first automating each player station 32 to automatically collect ante bets $B_1$. The system senses each ante bet and provides accounting information so that the operator of the game is assured that all ante bets are collected so as to substantially minimize any taking by assistants. The present invention further provides a novel progressive level of betting which can continue from game to game until an overall jackpot is won. Hence, the progressive system for the match number game of the present invention satisfies the above needs. The present invention provides the same accounting for its progressive bets.

SUMMARY OF THE INVENTION

A progressive system for a match number game is disclosed. The game is played with a plurality of coins and the match number game includes a fixed number of game cards selected at random from a total number of game cards. Each game card has first, second, and third numbers displayed thereon. The first number displayed is a number from 1 to 10, the second number displayed is a number from 11 to 20, and the third number displayed is a number from 21 to 30. Each player has a player station. Each player can play from 1 to 4 cards at each player station. An ante coin acceptor is located near each played card on each player's station. A progressive coin acceptor is also located on each player station. A player places an ante bet or a progressive bet by placing coins in the ante and progressive coin acceptors. Each coin acceptor has a slot, a sensor for sensing the presence of a coin, when the coin is inserted into the coin acceptor, a light, a coin release mechanism, and a lockout device. A controller controls the operation of the coin acceptors.

The operator of the game causes the controller connected to all ante coin acceptors to drop all sensed coins into a drop bucket, to activate a verification light that the coin has been received and to lockout the coin acceptor to prevent future insertion of a coin. The progressive coin controller performs the same functions with the progressive coin acceptors. The game is played by announcing randomly selected numbers from 1 to 30. This occurs sequentially and as each randomly selected number from 1 to 30 is selected, it is called out. At the beginning of the game, the first three randomly selected numbers called, if those three match on a given card and if the player has placed a progressive bet, the player wins the progressive jackpot in addition to winning the game bet. The progressive jackpot is incremented each game by an amount determined by all progressive bets during that game. If no winner occurs during the first three randomly selected numbers of a game, the progressive jackpot amount is continually displayed until the next game where it is again incremented by the amount of progressive bets. This continues from game to game until a progressive game winner is announced.

BRIEF DESCRIPTION OF THE DRAWING

FIG. 9 illustrates the operation of the coin lock-out mechanism of the present invention.

FIG. 10 illustrates the electronic control circuitry for the mechanisms of FIGS. 7–9.

FIG. 11 sets forth the progressive display of the present invention.

DETAILED SPECIFICATION

1. Player Station

For uniformity of presentation and for convenience, the referenced numerals in the prior art figures of FIG. 1 through FIG. 4 are used in the ensuing figures.

Figure 5:
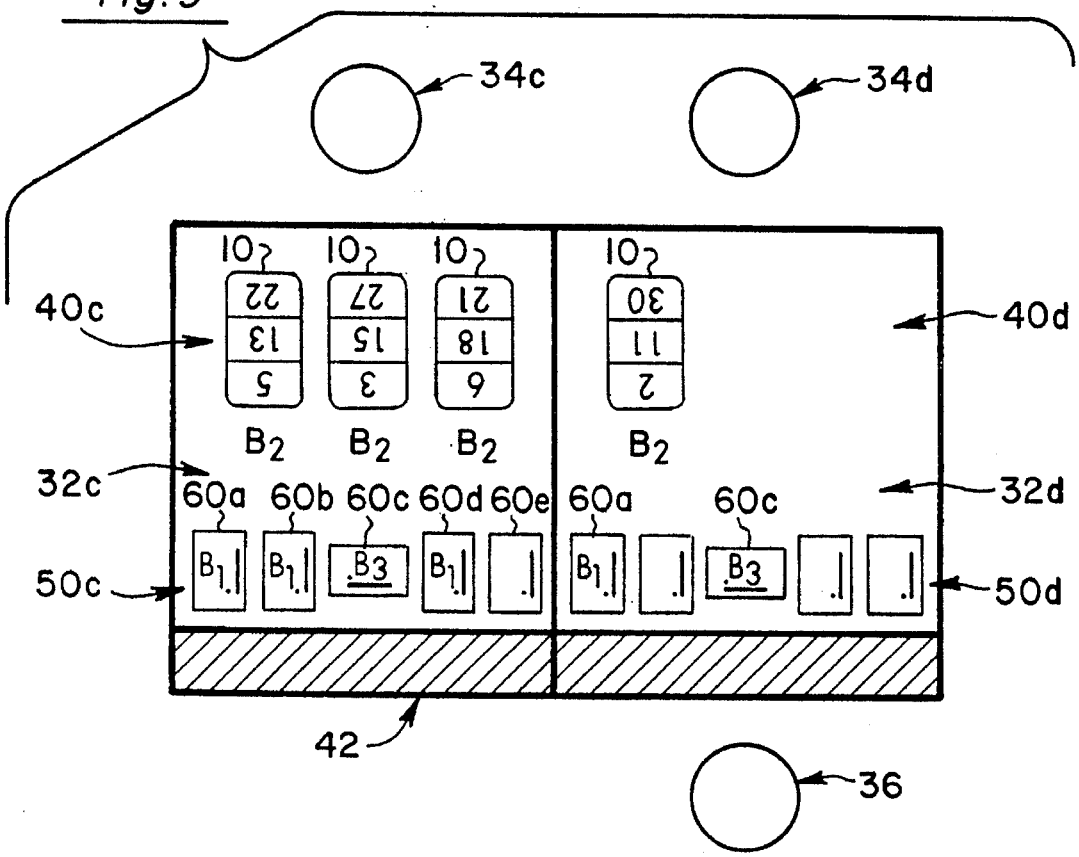
FIG. 5 illustrates two player stations of FIG. 4 modified under the teachings of the present invention.

In FIG. 5, the player stations 32*c* and 32*d* of the present invention are set forth. Each player station has a playing surface 40 and, as before, each player 34 has a number (such as 1 through 4) of cards 10 placed in front of him. The present invention provides a bank 50 of coin acceptors 60 on the end 42 of each player station 32 towards the assistant 36. Each bank 50, in the preferred embodiment, has 5 coin acceptors 60 oriented as shown in FIG. 5. The middle coin acceptor 60*c* is orthogonal to the outer four coin receptors 60*a*, 60*b* and 60*d*, 60*e*. At least one ante coin acceptor is provided under the teachings of the present invention near each card player position at each player station.

Figure 4:
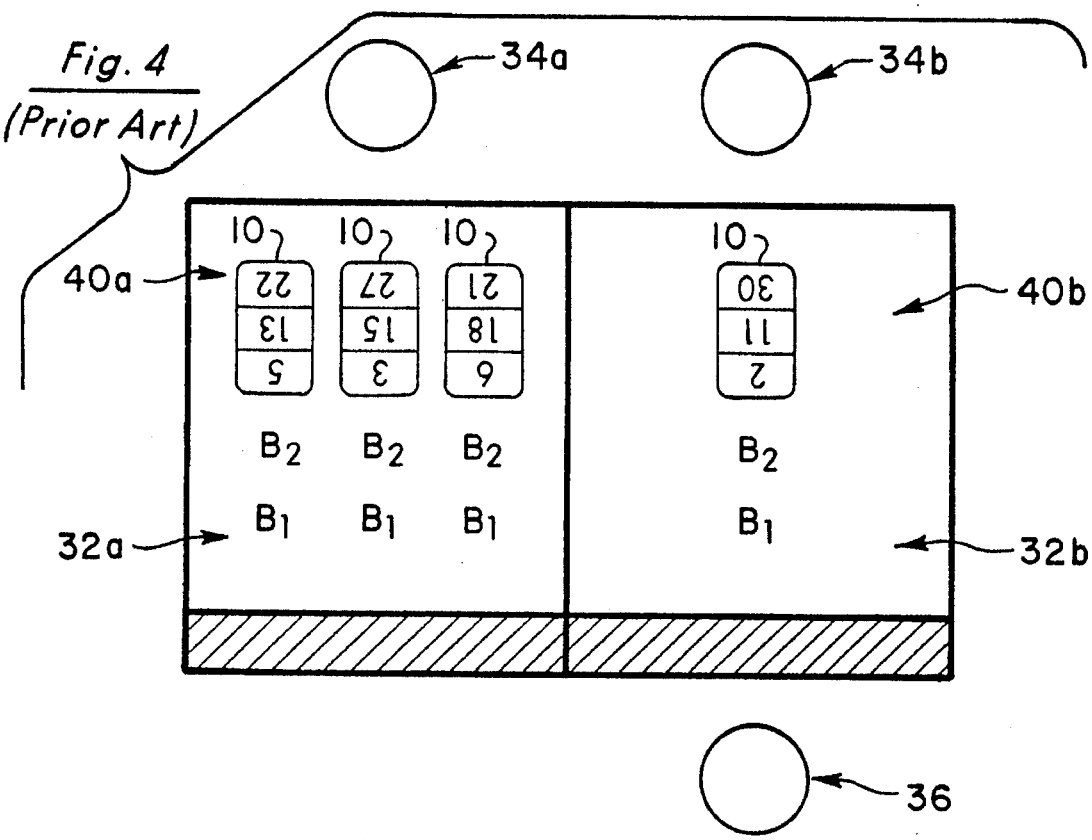
Fig. 4 (Prior Art)
FIG. 4 is a prior art representation of two player stations.

Under the teachings of the present invention, each player 34 places an ante wager $B_1$ (i.e., coin, token or gaming chip, hereinafter referred to as simply "coin") in the electromechanical coin acceptors 60*a*, 60*b*, 60*d* and 60*e*. In FIG. 5, therefore, player 34*c* places ante bet $B_1$ in acceptors 60*a*, 60*b*, and 60*d* since player 34*c* only has three cards. Nothing is placed in acceptor 60*e*. Likewise, player 34*d* having only one card 10 places ante bet $B_1$ in the acceptor 60*a*. Each player 34 still places the game bet $B_2$ such as three chips for each card 10 on the table surface 40*c* in front of each card as shown in FIGS. 4 and 5. Hence, as shown in FIG. 5, player 34*c* places game bet $B_2$ in front of each card whereas player 34*d* only places one game bet $B_2$ in front of his card 10.

The present invention provides a third progressive bet $B_3$ which is placed in acceptor 60*c*. This is a single chip and constitutes a bet towards an aggregate, progressive jackpot. Under the teachings of the present invention, a player 34 has the option of placing the progressive bet $B_3$ in acceptor 60*c*. Bets $B_1$ and $B_2$ are not optional and are required to play the game.

As shown in FIG. 5, the present invention provides specially designed tables 32 having an optional progressive wager capability 60*c* (bet $B_3$). The location of the progressive bet coin acceptor 60*c* is immaterial under the teachings of the present invention and can be located anywhere on the player station 32. The player station 32 of the present invention incorporates two types of electronic coin acceptors for the ante (bet $B_1$) and progressive (bet $B_3$) wagers. The design, location, and orientation of the coin acceptors is a matter of choice and is not limited under the teachings of the present invention.

2. Control of Ante and Progressive Betting

Figure 6:
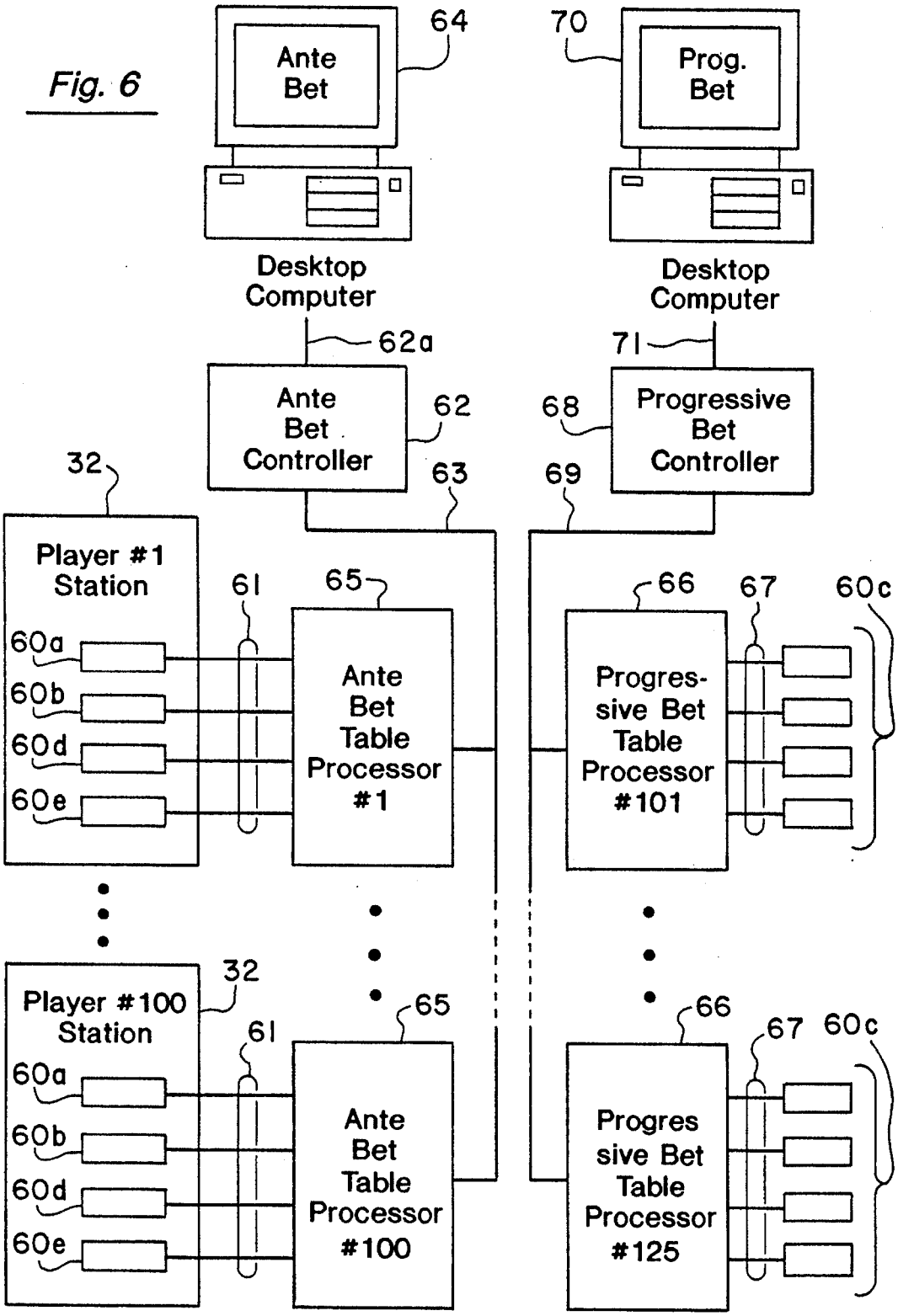
FIG. 6 sets forth the electronic block diagram of the control system of the present invention.

In FIG. 6, the system of the present invention for controlling the placement of the ante bet $B_1$ and the progressive bet $B_3$ is set forth. Each player station 32 has a table processor or interface circuit 65 connected to each coin acceptor 60*a*, 60*b*, 60*d*, and 60*e* corresponding to the placement of the ante bet $B_1$. The control signals from the table processor 65 and the acceptors 60*a*, 60*b*, 60*d*, and 60*e* are delivered over lines 61. Each ante bet table processor 65 is connected to controller 62 over a bus 63. The ante bet controller 62 interfaces with an ante bet desktop computer 64 over bus 62*a*.

Likewise, a separate progressive bet processor 66 is interconnected to the progressive bet $B_3$ coin acceptors 60*c* on four separate player stations 32. The progressive bet processor is connected over lines 67 to the progressive bet coin acceptors 60*c*. Each table processor 66 is connected to a progressive bet controller 68 over lines 69 and thence to a progressive bet computer 70 over lines 71.

Figure 3:
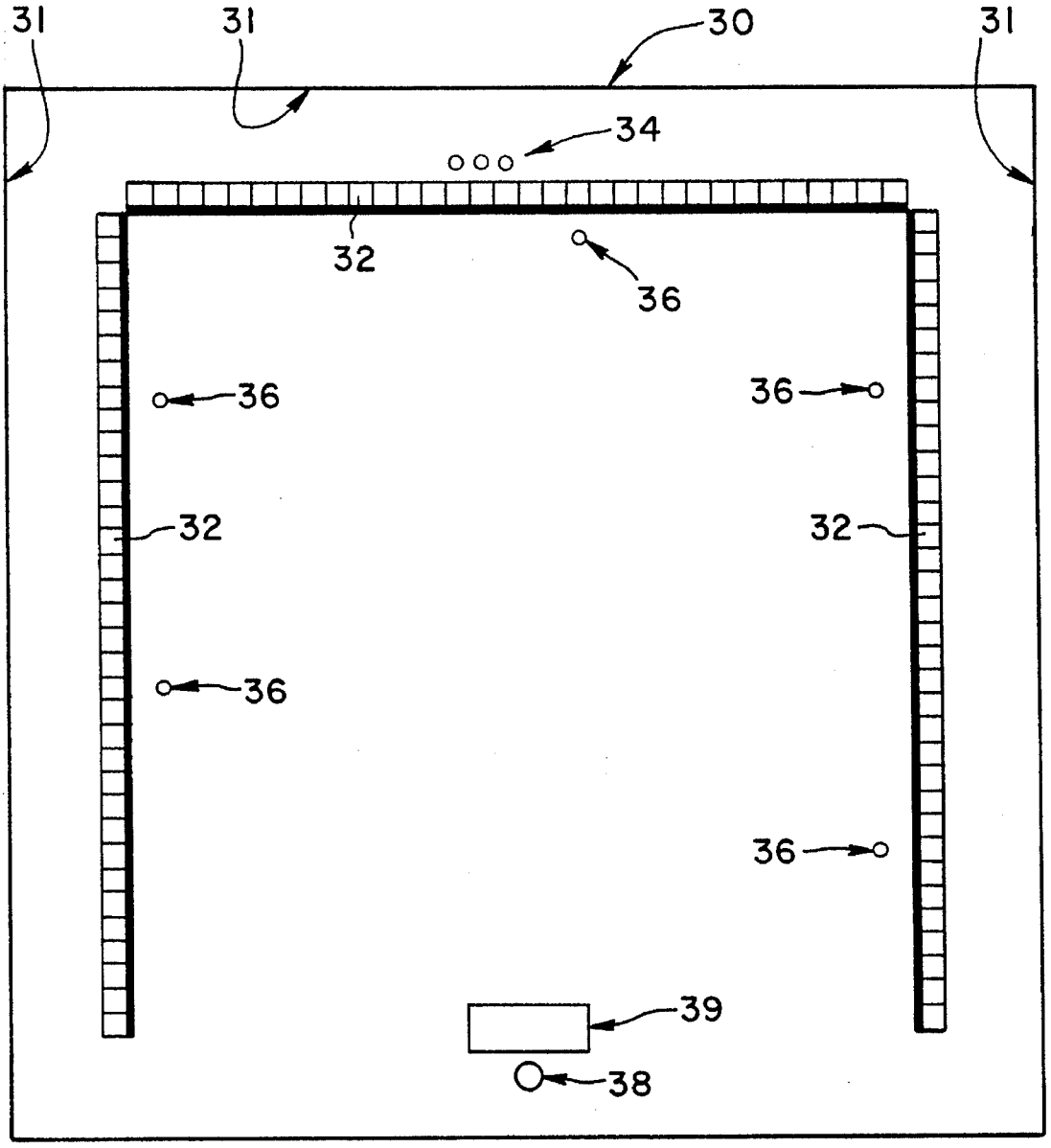
Fig. 3 (Prior Art)
FIG. 3 is a prior art representation of a room containing a large number of player stations.

As shown in FIG. 6, to handle a game set forth in FIG. 3 of 100 player stations 32, 100 ante bet processors 65 would be required connected to a total of 400 ante bet coin acceptors 60. To process the progressive bet $B_3$, 25 progressive bet processors 66 would be connected to the 100 progressive bet coin acceptors 60*c*. The desktop computers 64 and 70 are dedicated to the type of bet being monitored. Desktop computer 64 provides the accounting for the ante bets $B_1$ placed in the coin acceptors 60*a*, 60*b*, 60*d*, and 60*e* whereas desktop computer 70 provides the accounting for the progressive bet $B_3$ placed in coin acceptors 60*c*. The desktop computers 64 and 70 can be any conventional personal computer.

It is to be expressly understood that while FIG. 6 sets forth a preferred embodiment, variations on that could be made. For example, the ante bet processors 65 could be designed to handle more than one player station 32 and the progressive bet processor 66 could be designed to handle more than four progressive coin acceptors 60*c*.

What is shown in FIG. 6 is an automated system for controlling each ante and progressive bet coin acceptor 60 and providing accounting information from each coin acceptor 60 back to centralized computers. Indeed, even though the term table processor is used for processors 65 and 66, under the teachings of the present invention, these table processors are no more than an electronic interface printed circuit boards that are capable of accepting and converting signals from the coin acceptor 60 into electronic signals transmitted to a controller (either 62 or 68). Each board could be conventionally controlled by any standard microprocessor or formed of conventional signaling circuits. The actual design is not important to the teachings of the present invention.

The ante bet controller 62 and the progressive bet controller 68 are designed to accept coin-in signals from the table processors 65 and 66 and to transmit those signals to the computers (64 and 70) for accounting purposes.

3. Coin Acceptor

The operation of the coin acceptors 60 illustrate important features to the present invention. In the preferred embodiment, each coin acceptor 60 is a combination of a lock-out device and a coin-in signal generator.

Figure 7:
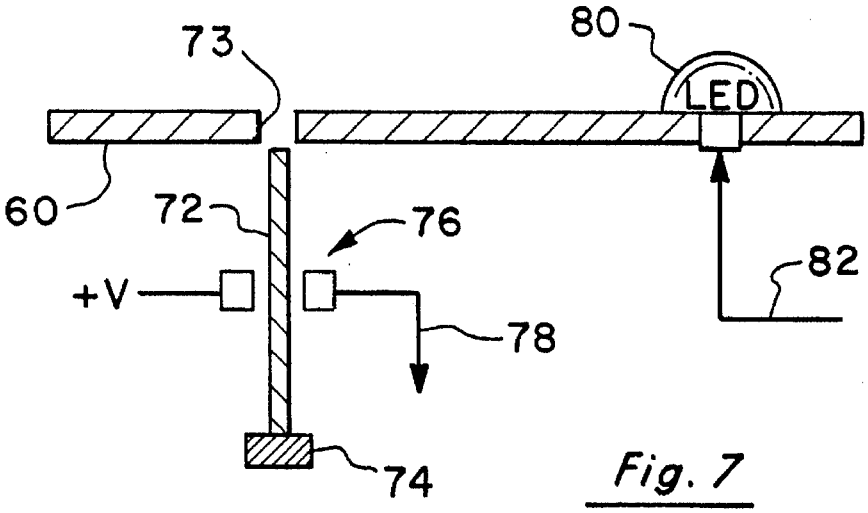
FIG. 7 illustrates the operation of the coin-in sensor.

In FIG. 7, the coin-in signal generator is illustrated. The acceptor 60 is partially illustrated in FIG. 7 showing a coin 72 inserted into the coin slot 73 of the acceptor 60. The coin goes in a predetermined distance and is stopped by an abutment 74. An opto-sensor 76 is provided. The opto-sensor 76 generates a coin-in signal 78 to the processor 65 (or 66). The processor 65 (or 66) delivers it to the controller 62 (or 68).

As shown in FIG. 7, an LED 80 is illustrated which is selectively turned on and off by the processor 65 (or 66) over line 82. The light emitting diode (LED) 80 is illuminated to indicate that a wager, as represented by coin 72, has been recorded by the controller 62 (or 68). It also indicates when lit that the coin acceptor 60 is now locked out precluding any further wagers until the end of the game. This will be explained later.

Figure 8:
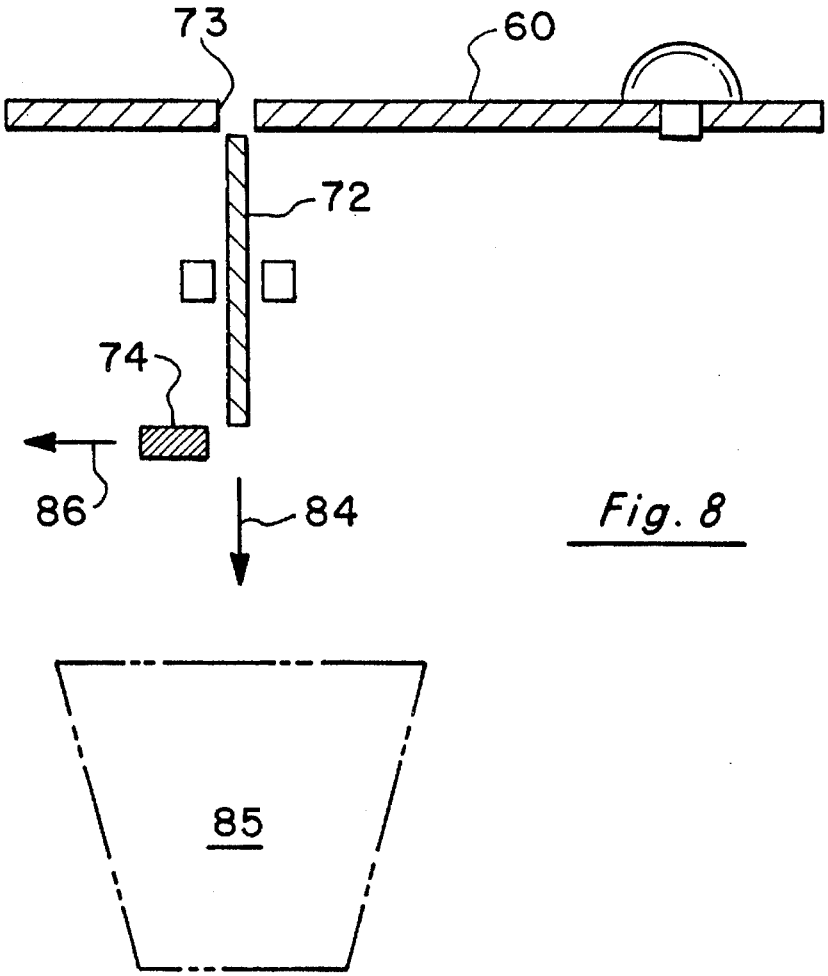
FIG. 8 illustrates the operation of the coin release mechanism.

When all players have placed their coin 72 into the slot 73 and the bet has been recorded by the processor 65 (or 66), the controllers 62 and 68 will accept the bet causing each coin acceptor 60 to release the inserted coin 72 as shown in FIG. 8. The coin 72 drops in the direction of arrow 84 into a drop bucket 85. The release of the coin 72 occurs by removing the barrier 74 in a direction such as 86. It is to be expressly understood that any of a number of mechanical arrangements could be used to provide the barrier 74 and the release of the barrier 86 such as by for example a simple relay having a plunger being retracted in the direction of arrow 86. It is to be expressly understood that devices and mechanisms for accepting coins are well known in the art and that the teachings of the present invention are not to be limited to the particular type of design.

After the coin 72 is dropped 84, it now becomes necessary to lock-out any further wager being placed in the coin acceptor and to light the LED 80. Hence as shown in FIG. 9, a mechanical solenoid 88 is provided with a plunger 90 which can selectively move in direction 92. After the coin 72 is dropped 84 in FIG. 8, the solenoid 88 is activated by the processor 65 (or 66) to extend its plunger 90 in the direction of arrow 92 to block the drop of another coin 72 into coin acceptor 60. Again, this feature is illustrated since its design can encompass a number of different mechanical arrangements all of which are well known in the art. Hence, the player at station 32 is locked out from placing any other wager 72 into an acceptor 60. However, a new coin 72 can be inserted into slot 73 so as to be oriented and ready for insertion. In this orientation, the coin 72 extends a distance "D" above the acceptor 60.

This serves another important function. At the start of each game, the coins are placed in the slot with the lock-out activated. The coins are "ready-to-be-inserted." The operator causes the controller 68 to deactivate all "ready-to-be-inserted" coins so that all progressive bets $B_3$ occur at the same time.

What has been shown in FIGS. 7–9 is a unique coin acceptor unit for utilization in the progressive number game of the present invention by providing a combination lock-out device and coin-in signal generator.

In FIG. 10, the electronic diagram implementing these features is set forth. The processor 65 drives the LED 80 over line 82, receives coin-in signals from the opto-sensor 76 over line 78, controls the operation of the coin release by removing abutment 74 through an activation 86, and activates the lock-out solenoid 88 over line 89.

In summary, each ante and progressive coin acceptor includes a slot 73, a sensor 76, a light 80, a coin release 74, and a lock-out 88. While this constitutes the preferred embodiment, the teachings of the present invention as set forth in the claims are so limited. For example, the light could be a tone or a combination of a light or a tone. The light serves as verification that a bet was placed, inserted, and dropped. Hence, the light could be a printed receipt. These and other changes could be made without departing from the spirit of the invention.

4. Ante and Progressive Bet Accounting

One of the needs of the present invention is to substantially minimize assistant handling of bets so as to reduce the risk of theft. The present invention provides a novel system for achieving this. The following discussion is directed toward the collection of ante bets. Each ante bet acceptor 60*a*, 60*b*, 60*d*, and 60*e* has a drop bucket or these acceptors can be directed into a single drop bucket. The ante bet computer 64 provides accounting from game-to-game so that each inserted and accepted coin that drops into a bucket is known from the coin-in signal. The acceptors 60 eliminate the need to have assistants sweep the ante bets thereby eliminating a first level of employee handling. At the end of the day, the exact value of each drop bucket at each player station is known by computer 64. Hence, when the drop buckets are collected, the exact count in each bucket must match the exact count in computer 64. If not, the system should first be tested for operation and, if operational, then security should investigate.

5. Game Play

Figure 1:
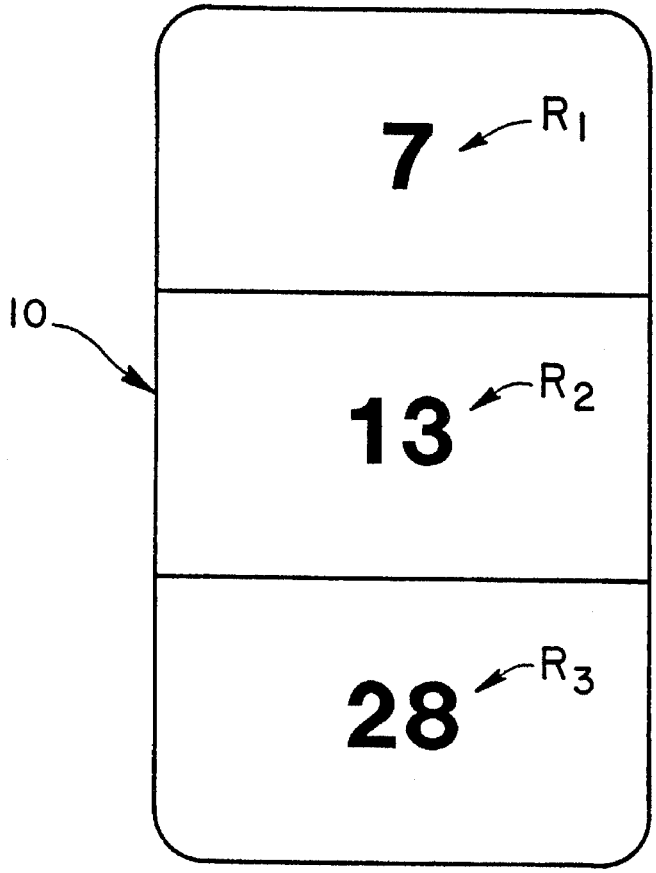
Fig. 1 (Prior Art)
FIG. 1 is a prior art representation of a match number game card.
Figure 2:
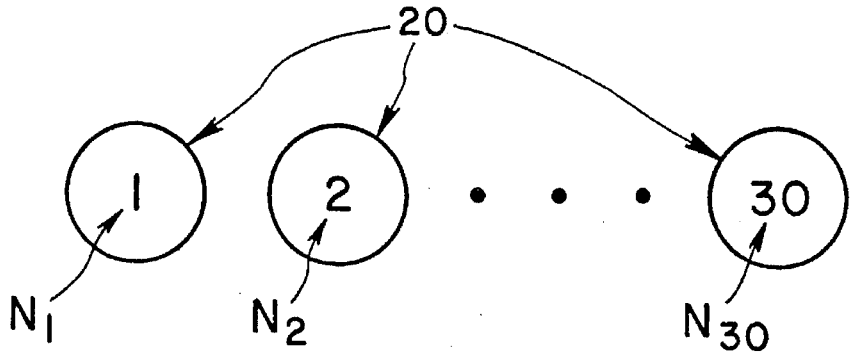
Fig. 2 (Prior Art)
FIG. 2 is a prior art representation of the game balls for the match number game.

There are thirty balls 20 (FIG. 2) bearing numbers N numbered 1 through 30. The balls 20 do not have a subordination to an alphabetical category such as B-12 or K-3, so forth. The game (FIG. 3) is limited generally to 100 players per session having 100 player positions 32 with each station having five coin acceptors 60 (see FIG. 5) for receiving the ante $B_1$ and progressive $B_3$ wagers. Players 34 choose one to four preprinted cards 10 (FIG. 1). These cards 10 are selected from a predetermined pool which for 100 players in the preferred embodiment is four in a pool of a predetermined playing number of cards 10 which in the preferred embodiment is 400. These 400 cards 10 are selected randomly by the operator of the match number game from the 1,000 available combinations of the three numbers. Hence, prior to the game, 400 playing cards are randomly selected from a total set of 1,000 cards 10 on a random basis. These 400 cards are typically mounted on the walls 31 of the room 30 for ease of selection by a player 34. Between games, players can return cards and select new cards if they so desire.

In order to participate in wager on a game card 10, the player 34 must place an ante wager $B_1$ in the ante bet coin acceptor (i.e., 60*a*, 60*b*, 60*d*, or 60*e*) (the coin is "ready-to-be-inserted") directly over each game card being played. This is shown in FIG. 5 wherein game card 10 for player 34*d* is oriented directly behind (or in line with) its coin acceptor 60*a*. Additionally (and optionally) the player 34 may wager a progressive bet $B_3$ in the progressive bet coin acceptor 60*c* (the coin is "ready-to-be-inserted"). This wager makes the player eligible to win the progressive jackpot.

At the same time the player 34 places the ante $B_1$ and progressive $B_3$ wagers, the player places the game bet $B_2$ (i.e., usually three coins) on the playing station surface near the top of each card 10 being played as shown in FIG. 5. This wager can be any amount which is agreed upon in the operation of the game.

The game caller 38 makes a "cease betting" announcement. At that point, the operator activates the controllers 62 and 68 which in turn sends signals to the table processor 65 and 66 to deactivate the lock-out 88 causing the coin 72 to be inserted and detected by sensor 76. The coin release 74 is activated so that the ante $B_1$ and progressive $B_2$ wagers are delivered into respective drop buckets 85. In other words, a bucket 85 is placed below each coin acceptor 60. The lock-out is reactivated. The light 80 becomes light at any time during this process.

The start of the game commences. The ball blower 39 is activated and the first ball 20 is randomly chosen. The game caller 38 calls out the ball number and the ball number can also be entered into a graphic display for all to see.

All players who have the first ball number on a game card 10 cover that number with one of the three coins comprising bet $B_2$ leaving the remaining two coins at the $B_2$ bet position over the top of the card 10.

The second and third balls 20 are selected by the ball blower 39 and are announced by the caller 38. The caller pauses at this point to see if any player has "caught" the first three numbers for a progressive jackpot win. This is an important feature of the present invention. If all 1,000 possible combinations of the three numbers were in the game room being played, there would be one player having a card that would have the three numbers called during the first three balls. However, only 400 cards 10 are randomly selected and, therefore, it is entirely possible that the first three balls will not match to a particular played game card 10. This adds a new level of excitement in playing the game. When the first three numbers are matched, the player having the first three yells out and a verification takes place. If the player is verified (i.e., do the three numbers on the card match and is light 80 on? ) to be a winner the player then wins the primary progressive jackpot as well as all the game wager $B_2$from all of the other players (i.e., the normal win payout). This game round is immediately over with. A new game begins.

However, if there is no winner after the first three balls, the fourth ball is selected by the ball blower 39 and announced by the caller 38. Again, under the teachings of the present invention, a player still may win a progressive jackpot if a player has the first three numbers on a card from the first four ball numbers called out. This is a second level win in the progressive jackpot. Again, this is an optional feature of the present invention and adds an additional layer of excitement to the game. Again, a player having three numbers on a card out of the first four ball numbers called yells out. A verification takes place and if the player is eligible wins the lower secondary progressive jackpot. The player also wins the normal win payout represented by bet $B_2$.

If there is no winner after the first four balls 20, the caller 38 continues announcing the ball numbers as they are selected by the ball blower 39. This continues until some player covers the three numbers on a game card with coins from bet $B_2$. The player yells out the win and a verification takes place (i.e., do the three numbers on the card match). At this time, the player only wins the normal win payout as represented by bet $B_2$. The game is now over.

6. Progressive Wager

As set forth above, an important feature of the present invention relates to the progressive bet feature being added by the present invention. A progressive wager is a bet of which a portion is contributed to a constantly augmenting jackpot, which is referred to as a "progressive jackpot." A progressive jackpot can be divided into a "primary" (or upper) and a "secondary" (or lower) amount.

All progressive bets $B_3$ placed towards the progressive jackpot by individual players 34 contribute to increasing the primary and secondary amounts of the progressive jackpot. These progressive bets $B_3$ also provides verification (i.e., light 80 is on) that each player who places a progressive wager is eligible to win either the primary or secondary jackpots.

The progressive jackpot of the present invention is incremented by each progressive bet $B_3$. For example, when the wager is a dollar and is bet by a player 34 in the progressive bet coin acceptor 60*c*, the following occurs. The game operator 38 calls for the players to place their bets. Each player places the coin 72 into the slot 73 of a coin acceptor 60 as shown in FIG. 9—the coins are in the "ready-to-be-inserted" position. The operator of the controller 68 activates the controller (see FIG. 11) to issue a coin insertion signal over bus 69 to each table processor 66 which thereupon issues a coin release on line 89 to the lock-out device 88. The coin 72 as shown in FIG. 7 drops past the opto-sensor 76 and abuts surface 74. The passage of the coin 72 by the opto-sensor 76 generates the coin-in signal on line 78 and the table processor 66 delivers it to the progressive controller 68. 2. The controller receives the coin-in signals from each table processor 66 and adds a defined amount of each wager to the progressive jackpot. For example, if the incrementation rate were set to 70% each dollar wagered would increment the jackpot by 70¢ so that if all 100 players had placed a progressive bet $B_3$, the overall progressive jackpot would be incremented by $70. The incrementation rate, of course, can be set accordingly. The lockout device is activated to prevent a new coin inserted by extending plunger 90 as shown in FIG. 9. The coin 72 is released to drop into bucket 85 by activating device 74. The light 80 is turned on verifying that the progressive bet $B_3$ has been accepted.

7. Controller

The controllers 62 and 68 are conventional controllers of the type, for example, manufactured by Mikohn Gaming Corporation. Such controllers have been used to process coin-in information from gaming equipment such as slot machines.

In FIG. 11, the controller 68 is shown interconnected to a progressive display 91 which contains two display fields: a primary display field 92 and a secondary display field 94. The primary display field 92 displays the primary progressive jackpot which would be paid upon a given game card having numbers corresponding to the first three numbers called and the secondary field 94 contains the value that a player would receive if the player has a game card that has numbers corresponding to three of the first four numbers called. It is to be expressly understood that variations, under the teachings of the present invention, could be made.

Single Jackpot

Under this embodiment, only the primary field 92 is used and a progressive jackpot is paid only for a player having a card during which the first three numbers of a game called correspond to the numbers on his card.

Primary/Secondary Jackpots

Under this embodiment, the primary and secondary fields 92 and 94 are utilized. A player winning the primary value in field 92 would do so when the first three numbers called correspond to the three numbers on his card. A player winning the secondary value in field 94 would win if his card contains the three numbers for the first four numbers called.

Primary/Secondary/Tertiary Jackpots

Indeed, and yet another embodiment, three fields could be provided wherein a tertiary value (shown by dotted lines 96 in FIG. 11) would be displayed wherein a player having a card that contains three numbers out of the first five numbers called could win.

It is to be expressly understood that under the teachings of the present invention the primary/secondary/tertiary or even more successive jackpots could be provided.

In summary, the ante table processors 65 and ante controller 62 act together to control the operation of each ante coin acceptor for receiving all the coin-in signals and for activating the light, the coin release, and the lock-out in the ante coin acceptor.

8. Method of Operation

The method of operation of the present invention is as follows: a set of game cards 10 is provided. The set includes all possible combinations of the numbers $R_1$, $R_2$, and $R_3$. In the preferred invention, this is 1,000. Each game card has a first number from 1 to 10, $R_1$; a second number from 11–20, $R_2$; and a third number from 21–30, $R_3$. These numbers are displayed on the game card. It is to be expressly understood that while a printed game card is shown in FIG. 1, the game card could be a video display on a video screen.

A game is played by collecting a playing number of game cards from the set of game cards. As discussed, the playing number is preferably 400 for 100 players. This number may be greater or less than 400 depending upon the number of players in a game. The present invention is not to be limited by the actual playing number of game cards. Each of the players selects one or a predetermined number of game cards from the playing number. In the preferred embodiment, a player may select 1, 2, 3, or 4 separate game cards. Each player who desires to play the progressive game of match then places a coin in the coin acceptor slot in a "ready-to-be-inserted" position (i.e., the lockout of FIG. 9 has its plunger 90 activated to prevent complete insertion). When all players have placed their progressive bets in a ready-to-be-inserted position, the announcer activates the progressive controller by means of a suitable input 100 shown in FIG. 11 to deactivate the lockout device thereby causing the coin to be inserted and sensed by the sensor 76. A coin-in signal 78 is issued, the light 80 is activated, and the coin is dropped with the immediate subsequent activation of the lockout device to prevent additional coin insertions. The light 80 is a verification signal that is issued at all player positions placing a progressive bet. The verification signal can comprise any form of verification. The present invention is not to be limited to the lighting of the light. The progressive controller 68 then determines the amount the progressive jackpot displayed 92 needs to be incremented. The incremented amount is then displayed as shown in FIG. 11.

One of 30 numbers from 1 to 30 is then randomly selected from ball blower 39. After performing this step of random selection three times at the very beginning of the game in sequence, any player that has the three initially selected numbers on a single game card and who has placed a progressive bet wins the jackpot amount and is paid. If no player wins, the normal game continues, but the progressive jackpot amount continues to be displayed.

During the next game, these steps are repeated causing the jackpot amount to be further incremented and to determine whether or not a player will win the next game. This process continues game after game after game until a winner (i.e., a player having the first three numbers match on a single card is verified and paid. Of course, these steps are modified based upon the different embodiments for the progressive number games set forth above. The order of the steps are not necessarily critical since whether the step of lockout or the step of lighting the light occurs before or after dropping of the coin which is inserted occurs is immaterial.

The invention has been described with reference to the preferred embodiment. Modifications and alterations will occur to others upon a reading and understanding of this specification. It is intended to include all such modifications and alterations insofar as they come within the scope of the appended claims or the equivalents thereof.

I claim:

1. A progressive system for a match number game played with a plurality of coins, said match number game including a fixed number of game cards selected at random from a total set of game cards, each game card having first, second, and third numbers displayed thereon, said first number being a number from 1 to 10, said second number being a number from 11 to 20, said third number being a number from 21 to 30, said game further including means for randomly selecting one of thirty numbers from 1 to 30, said progressive system comprising:

a plurality of player stations, at least one card playing position at each of said player stations, an ante coin acceptor located near each said at least one card playing position on at each of said plurality of player stations, a progressive coin acceptor located on each of said plurality of player stations, each said ante and progressive coin acceptor including:

a) a slot, b) a sensor for sensing the presence of a coin from said plurality of coins when said coin is inserted into said coin acceptor, said sensor issuing a coin inserted signal, c) a light, d) a coin release for accepting said inserted coin, e) a lock-out for preventing the insertion of a coin into said coin acceptor, said lock-out orienting said coin in said slot for subsequent insertion into said coin acceptor, means connected to one or a plurality of said ante coin acceptors for controlling the operation of each said ante coin acceptor, said ante coin acceptor controlling means further receiving said coin inserted signal from said sensor in said ante coin acceptor, said ante coin acceptor controlling means further activating said light, said coin release, and said lock-out in said ante coin acceptor, means connected to one or a plurality of said progressive coin acceptors for controlling the operation of each progressive coin acceptor, said progressive coin acceptor controlling means receiving said coin inserted signal from said sensor in said progressive coin acceptor, said progressive coin acceptor controlling means activating said light, said coin release, and said lock-out in said progressive coin acceptor, said progressive coin acceptor controlling means determining when each progressive bet coin is inserted into each progressive coin acceptor upon receipt of said coin insertion signal, said progressive coin acceptor controlling means after said determination activating said coin release so as to accept said coin, said lock-out so as to prevent another coin from being inserted, and said light so as to provide verification that a coin was inserted, means connected to said progressive coin acceptor controlling means for displaying at least one progressive jackpot amount, said at least one progressive jackpot amount being paid when a game card in said fixed number of game cards contains numbers that match the first three numbers selected from the selecting means.

2. A progressive system for a match number game played with a plurality of coins, said match number game including a fixed number of game cards selected at random from a total number of game cards, each game card having first, second, and third numbers displayed thereon, said first number being a number from 1 to 10, said second number being a number from 11 to 20, said third number being a number from 21 to 30, said game further including means for randomly selecting one of thirty numbers from 1 to 30, said progressive system comprising:

a plurality of player stations, at least one card playing position at each of said player stations, a progressive coin acceptor located on each of said plurality of player stations, each said progressive coin acceptor including:

a) a slot, b) a sensor for sensing the presence of a coin from said plurality of coins when said coin is inserted into said coin acceptor, said sensor issuing a coin inserted signal c) a light, d) a coin release for accepting said inserted coin, e) a lock-out for preventing the insertion of a coin into said coin acceptor, said lock-out orienting said coin in said slot for subsequent insertion into said coin acceptor, means connected to one of a plurality of said progressive coin acceptors for controlling the operation of each progressive coin acceptor for receiving said coin inserted signal from said sensor in said progressive coin acceptor and for activating said light, said coin release, and said lock-out in said progressive coin acceptor, said progressive coin acceptor controlling means determining when each progressive bet coin is inserted into each progressive coin acceptor upon receipt of said coin insertion signal, said progressive coin acceptor controlling means after said determination activating said coin release so as to accept said coin, said lock-out so as to prevent another coin from being inserted and said light so as to provide verification that a coin was inserted, means connected to said progressive coin acceptor controlling means for displaying at least one progressive jackpot amount, said at least one progressive jackpot amount being paid when a game card in said fixed number of game cards contains numbers that match the first three numbers selected from the selecting means.

3. A progressive system for a match game played with a plurality of coins, said match game including a fixed number of game cards selected at random from a total number of game cards, each game card having a plurality of numbers displayed thereon, each said number of said plurality of numbers in a decade of numbers, N, said game further including means for randomly selecting one of N numbers, said progressive system comprising:

a plurality of player stations, at least one card playing position at each of said player stations, a progressive coin acceptor having a coin release and a removable plunger located on each of said plurality of player stations, for issuing a coin inserted signal when said coin is inserted into said coin acceptor and before said inserted coin is released by said coin release, said removable plunger further preventing the insertion of a second coin from said plurality of coins, means connected to one or a plurality of said progressive coin acceptors for automatically controlling the operation of each progressive coin acceptor to receive said coin inserted signal from said progressive coin acceptor, said automated progressive coin acceptor controlling means further activating said coin release to release said coin and activating said removable plunger to prevent said insertion of said second coin, said automated progressive coin acceptor controlling means determining when each progressive bet coin is inserted into each progressive coin acceptor upon receipt of said coin insertion signal, means connected to said automated progressive coin acceptor controlling means for displaying at least one progressive jackpot amount, said at least one progressive jackpot amount being paid when a game card in said fixed number of game cards contains numbers that match the first of said plurality of numbers selected from the selecting means.

4. A progressive match number game played by a plurality of players comprising the steps of:

a) providing a set of game cards, b) displaying a first number from 1 to 10 on each game card, c) displaying a second number from 11 to 20 on each game card, d) displaying a third number from 21 to 30 on each game card, whereby the set of game cards includes all possible combinations of said first, second, and third numbers, e) playing a game by:

selecting a playing number of game cards from said set of game cards, each player of said plurality of players selection one or a plurality of game cards from said playing number of game cards, at least one of said plurality of players placing a progressive bet in a ready-to-be-inserted position of a coin acceptor, inserting all of the ready-to-be-inserted progressive bets into the corresponding coin acceptors of each said at least one of said plurality of players placing said progressive bet, issuing a verification signal at each corresponding coin acceptor, releasing with a coin release all inserted progressive bets from all coin acceptors having said inserted bets, preventing with a lock-out plunger progressive bet insertions at each coin acceptor in response to the step of releasing, incrementing a progressive jackpot amount in proportion to the value of all released progressive bets, displaying the incremented progressive jackpot amount, randomly selecting one of thirty numbers from 1 to 30, after performing the aforesaid step three times in sequence, determining whether any game card selected by a player has the three initially selected numbers, if in response to the aforesaid step, a player has the three initially selected numbers, then verifying that the aforesaid player's verification light is on and paying the aforesaid player upon verification the displayed incremented progressive jackpot amount, if in response to the determining step, no player has the three randomly selected numbers, then continuing the display of the incremented progressive jackpot amount until the next incrementation of the progressive jackpot during the next game by repeating step (e).

5. A progressive system for a card game played with a plurality of coins, said progressive system comprising:

a plurality of player stations, at least one card playing position at each of said player stations, an ante coin acceptor located near each of said at least one card playing position at each of said player stations for issuing a coin inserted signal when one of said plurality of coins is inserted into said ante coin acceptor, said ante coin acceptor further having means for preventing the insertion of a second coin from said plurality of coins, a progressive coin acceptor located near each of said plurality of player stations for issuing a coin inserted signal when one of said plurality of coins is inserted into said progressive coin acceptor, said progressive coin acceptor further having means for preventing the insertion of a second coin from said plurality of coins, means connected to each ante coin acceptor for controlling the operation of each ante coin acceptor located near each of said at least one card playing position at each of said plurality of player stations, said ante coin acceptor controlling means receiving said coin inserted signal from said ante coin acceptor for releasing all inserted coins from all ante coin acceptors having inserted coins, said ante coin acceptor controlling means further activating said ante coin acceptor to prevent said insertion of said second coin, means connected to each progressive coin acceptor for controlling the operation of each progressive coin acceptor located near each of said plurality of player stations, said progressive coin acceptor controlling means further receiving said coin inserted signal from said progressive coin acceptor for releasing all inserted coins from all progressive coin acceptors having inserted coins, said progressive coin controlling means further activating said progressive coin acceptor to prevent said insertion of said second coin.

6. The progressive system of claim 5 further comprising means connected to said progressive coin acceptor controlling means for displaying at least one progressive jackpot amount.

7. The progressive system of claim 5 wherein each ante and progressive coin acceptor at least comprises:

a slot, a sensor sensing the presence of a coin in said slot for issuing said coin inserted signal, and a coin release for releasing said inserted coin.

8. A progressive system for a card game played with a plurality of coins, said progressive system comprising:

a plurality of player stations, at least one card playing position at each of said player stations, an ante coin acceptor located near each of said at least one card playing position at each of said player stations, a progressive coin acceptor located near each of said plurality of player stations, each said ante and progressive coin acceptors comprising:

a) a slot for receiving one said plurality of coins, b) a coin release mechanism for holding said received coin in said slot, said coin release mechanism selectively releasing said held coin, c) a sensor for issuing a coin-in signal when said received coin is held by said release mechanism, d) a lock-out device for preventing the insertion of a second coin from said plurality of coins into said slot.

9. A progressive game played by a plurality of players comprising the steps of:

each of said plurality of players placing an ante bet in a ready-to-be inserted position of an ante bet coin acceptor, at least one of said plurality of players playing an ante bet in the prior stop placing a progressive bet in a ready-to-be-inserted position of a progressive bet coin acceptor, inserting all of the ready-to-be inserted ante bets into the corresponding ante bet coin acceptors of each of said plurality of players, inserting all of the ready-to-be inserted progressive bets into the corresponding progressive bet coin acceptors of each of said at least one of said plurality of players placing said progressive bet, issuing a verification signal at each corresponding progressive and ante bet coin acceptor, releasing with a coin release all inserted ante bets and inserted progressive bets, preventing coin insertions by activating a plunger at each progressive and ante bet coin acceptor, incrementing a progressive jackpot amount in proportion to the value of all inserted progressive bets, and displaying the incremented progressive jackpot amount.

* * * * *

UNITED STATES PATENT AND TRADEMARK OFFICE

CERTIFICATE OF CORRECTION

PATENT NO. : 5,536,016

DATED : Jul. 16, 1996

INVENTOR(S) : David J. Thompson

It is certified that error appears in the above-indentified patent and that said Letters Patent is hereby corrected as shown below:

Abstract, line 1, after "A progressive system for a match number game." insert --The game is played with a fixed number of game cards selected at random from a total set of game cards.--

Abstract, line 11, delete "activate verification" and substitute --activate a verification--

Abstract, line 15, after "selective numbers from 1 to 30." insert --This occurs sequentially and as each randomly selected number from 1 to 30 is selected, it is called out.--

Abstract, line 19, after "jackpot." insert --The progressive jackpot is incremented each game by an amount determined by all progressive bets during that game. If no winner occurs during the first three randomly selected numbers of a game, the progressive jackpot amount is continually displayed until the next game where it is again incremented by the amount of progressive bets.--

FIG. 10, delete "65"

FIG. 11, delete "90" and insert therefor --91--

Column 4, line 4, delete "40c" and substitute --40--

Column 5, line 4, delete "an"

Column 5, line 17, delete "illustrate" and insert therefor --illustrates--

Column 6, line 8, insert --match-- after "progressive"

Column 6, line 12, delete "65" and substitute --601--

Column 6, line 21, delete "are so limited" and substitute --are not so limited--

Column 6, line 67, insert --a-- before "wager"

Column 7, line 17, delete "sends" and insert therefor --send--

Column 7, line 19, delete "$B_2$" and substitute --$B_3$--

Column 8, line 18, delete "provides" and substitute --provide--

Column 8, line 36, delete "68. 2." and substitute --68.--

Column 8, line 40, delete "70¢" and substitute --70¢--

Column 10, line 7, delete "card" and substitute --card)--

Column 10, line 10, delete "are" and substitute --is--

Column 10, line 35, delete "on at" and substitute --on--

Column 11, line 37, delete "a coin release for accepting said inserted coin," and substitute --a coin release for releasing said inserted coin, and--

UNITED STATES PATENT AND TRADEMARK OFFICE

CERTIFICATE OF CORRECTION

PATENT NO. : 5,536,016
DATED : Jul. 16, 1996
INVENTOR(S) : David J. Thompson

It is certified that error appears in the above-indentified patent and that said Letters Patent is hereby corrected as shown below:

Column 11, lines 38-41, delete "a lock-out for preventing the insertion of a coin into said coin acceptor, said lock-out orienting said coin in said slot for subsequent insertion into said coin acceptor," and substitute --a removable plunger preventing the insertion of a coin into said coin acceptor when said removable plunger is under said slot, said removable plunger orienting said coin in said slot for subsequent insertion into said coin acceptor,--

Column 11, line 42, delete "one of" and substitute --one or--

Column 11, line 47, delete "lock-out" and substitute --removable plunger--

Column 11, line 51, delete "insertion" and substitute --inserted--

Column 11, line 53, delete "release so as to accept said coin, said lock-out so as to" and substitute --release to release said coin, said removable plunger to--

Column 11, line 55, delete "so as"

Column 12, line 48, delete "selection" and substitute --selecting--

Column 13, line 27, delete "acceptor," and insert therefor --acceptor, said ante coin acceptor having a coin release,--

Column 13, line 30, start a new paragraph after "coins,"

Column 13, line 33, delete "acceptor," and insert therefor --acceptor, said progressive coin acceptor having a coin release,--

Column 13, line 42, delete "releasing" and substitute --activating said ante coin acceptor coin release to release--

Column 13, line 45, insert --preventing means of said-- after "said"

Column 13, line 52, delete "releasing" and substitute --activating said progressive coin acceptor coin release to release--

Column 13, line46 ,insert --preventing means of said-- before "ante"

Column 14, line 5, insert --and-- after "slot,"

Column 14, line 8, delete "signal, and" and substitute --signal.--

Column 14, line 9, delete "a coin release for releasing said inserted coin."

Column 14, line 23, delete "mechanism" and substitute --barrier located under said slot--

Column 14, line 24, delete "mechanism" and substitute --barrier--

Column 14, line 26, insert --located above said coin release barrier and under said slot-- after "sensor"

UNITED STATES PATENT AND TRADEMARK OFFICE

CERTIFICATE OF CORRECTION

PATENT NO. : 5,536,016

DATED : Jul. 16, 1996

INVENTOR(S) : David J. Thompson

It is certified that error appears in the above-indentified patent and that said Letters Patent is hereby corrected as shown below:

Column 14, line 27, delete "said release mechanism," and substitute --said coin release barrier,--
Column 14, line 28, delete "device" and substitute --plunger located between said sensor and said slot--
Column 14, line 37, delete "stop" and substitute --step--

Signed and Sealed this

Seventeenth Day of March, 1998

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,536,016

DATED : July 16, 1996

INVENTOR(S) : David J. Thompson

It is certified that error appears in the above-indentified patent and that said Letters Patent is hereby corrected as shown below:

In column 11, line 37, delete "a coin release for accepting said inserted coin," and substitute --a coin release for releasing said inserted coin, and--

Signed and Sealed this

Fifth Day of May, 1998

Bruce Lehman

*Attest:*

BRUCE LEHMAN

*Attesting Officer*

*Commissioner of Patents and Trademarks*